US005420002A

United States Patent [19]

Takada et al.

[11] Patent Number: 5,420,002

[45] Date of Patent: May 30, 1995

[54] SILVER HALIDE COLOR PHOTOGRAPHIC LIGHT SENSITIVE MATERIAL

[75] Inventors: Hiroshi Takada; Hiroyuki Hoshino, both of Hino, Japan

[73] Assignee: Konica Corporation, Tokyo, Japan

[21] Appl. No.: 973,085

[22] Filed: Nov. 6, 1992

[30] Foreign Application Priority Data

Nov. 20, 1991 [JP] Japan ..... 3-305078

[51] Int. Cl.[6] ..... G03C 1/46

[52] U.S. Cl. ..... 430/503; 430/567; 430/569

[58] Field of Search ..... 430/567, 569, 503

[56] References Cited

U.S. PATENT DOCUMENTS 5,145,768 9/1992 Ichikawa et al. ..... 430/569
5,147,773 9/1992 Tsaur et al. ..... 430/567

FOREIGN PATENT DOCUMENTS 0326853 8/1989 European Pat. Off. .
0451859 10/1991 European Pat. Off. .

*Primary Examiner*—Charles L. Bowers, Jr.
*Assistant Examiner*—Geraldine Letscher
*Attorney, Agent, or Firm*—Frishauf, Holtz, Goodman & Woodward

[57] ABSTRACT

Disclosed is a silver halide color photographic light-sensitive material comprising a support having thereon a red-sensitive layer, a green-sensitive layer and a blue-sensitive layer, wherein at least one of said sensitive layer contains light-sensitive silver halide grains having the dispersibility of not less than 85%.

The silver halide color photographic light-sensitive material is improved in a high image quality and a pressure resistance.

13 Claims, 3 Drawing Sheets

SILVER HALIDE COLOR PHOTOGRAPHIC LIGHT SENSITIVE MATERIAL

FIELD OF THE INVENTION

This invention relates to a silver halide color photographic light sensitive material and particularly to a silver halide color photographic light sensitive material excellent in photosensitive speed, graininess and pressure resistive characteristics.

BACKGROUND OF THE INVENTION

Silver halide color photographic light sensitive materials have been required to have a high photosensitive speed and a high image quality and, at the same time, an excellent resistance against various pressures -the photographic characteristics vary only a little as a result of applying some pressure thereto-, which may be applied accidentally or naturally thereto while they are handled. As for the means for improving the pressure resistive characteristics, there have so far been a known technique in which a plasticizer is added into a subject silver halide emulsion so as to change the physical properties of a binder (such as gelatin) for dispersing the silver halide grains of the emulsion. This technique is, however, not always desirable, because the other photographic characteristics have to be also derived due to the changes of the physical properties of the binder. In addition the effects thereof have also been unsatisfactory.

As for the techniques in which the pressure resistance can be improved by silver halide grains themselves, there have been a known technique of silver halide grains having a core/shell structure, namely, the technique of a double-layer structured grains comprising each a core (or an inner layer) and a shell (or an outer layer) covering the core, in which the halogen compositions are different between the core and the shell, or the technique of a multilayer structured grains having a two or more layered structure. Still in these techniques, however, the pressure resistance improvement effects have not also been satisfactory enough, though these techniques can contribute to improve the photosensitive speeds greatly.

SUMMARY OF THE INVENTION

It is an object of the invention to provide a silver halide color photographic light sensitive material having satisfactory characteristics for solving the above-described problems and for fully achieving each of a high photosensitive speed, a high image quality and a pressure resistive characteristic improvement.

After the present inventors have variously studied, they have discovered that the above-mentioned objects of the invention can be achieved with the following silver halide color photographic light sensitive material;

(1) the silver halide color photographic light sensitive material comprising a support bearing thereon at least one or more layers each of a red sensitive emulsion layer, a green sensitive emulsion layer and a blue sensitive emulsion layer, respectively, wherein, in at least one of the light sensitive layers, the dispersibility of the light sensitive silver halide grains is not less than 85%; and (2) the silver halide color photographic light sensitive material as claimed in claim (1), wherein, in at least one of the light sensitive emulsion layers having a silver halide grain dispersibility of not less than 85%, the light sensitive silver halide grains contained in the light sensitive layer are comprised of the silver halide grains having an aspect ratio of not less than 3 in a projective area 20% or wider than the total projective area thereof.

From the above-described discovery, the present inventors have achieved the invention.

The term, 'the dispersibility of light sensitive silver halide grains' stated in the invention, is hereby defined as described below.

BRIEF DESCRIPTION OF THE DRAWINGS

As shown in FIG. 1, in a cross-sectional electron-microscopic photograph obtained by cutting a silver halide color photographic light sensitive material in the vertical direction to the support thereof, the numbers of light sensitive silver halide grains present in the region bounded by a and b of a subject light sensitive layer are counted at least not less than 50 positions, and the value obtained according to the following formula 1 is regarded as the dispersibility of the light sensitive layer.

In FIG. 1, a is the dried layer thickness of a light sensitive layer and b is the length 10 times as long as the layer thickness, ($b=a\times 10$)

Formula 1

Figure 1:
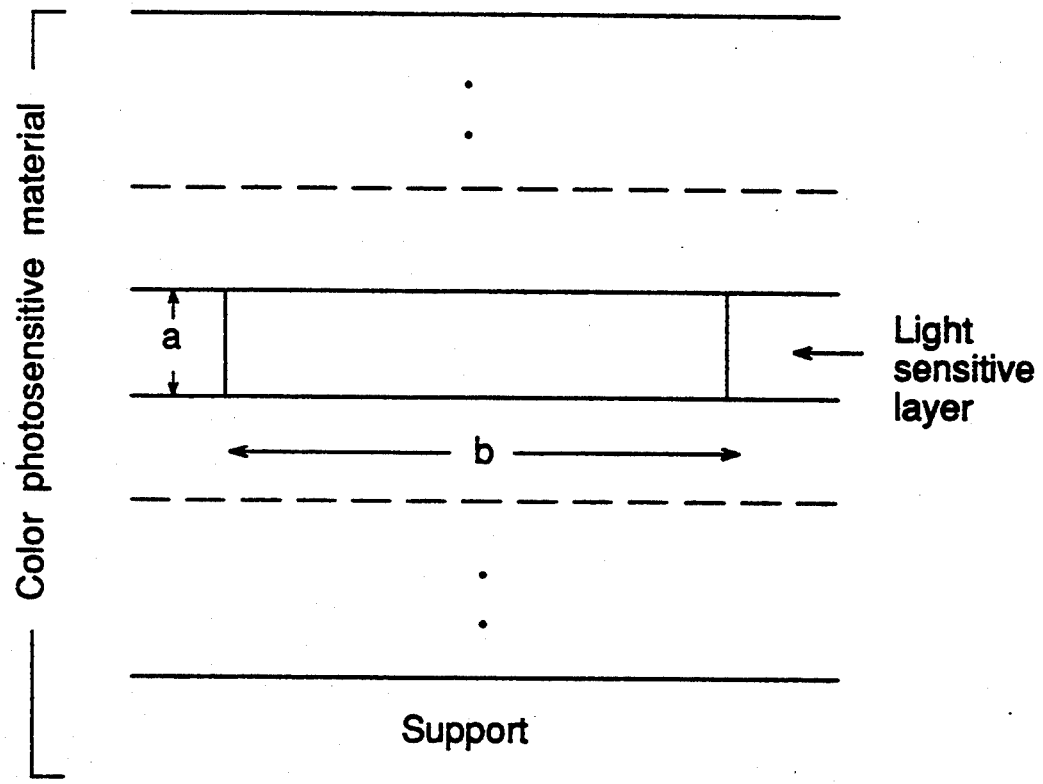
FIG. 1 is the cross-sectional view of a silver halide color photographic light sensitive material.

$$\text{Dispersibility (\%)} = \left[1 - \frac{\text{(Standard deviation of grain numbers)}}{\text{(Average value of grain numbers)}}\right] \times 100$$

The term, an 'aspect ratio', means a ratio of the diameter of a circle having an area equivalent to the projective area of a grain to the thickness of the grain; that is, (=a diameter converted into a circle/a grain thickness).

DETAILED DESCRIPTION OF THE INVENTION

The light sensitive materials of the invention comprise at least one of the light sensitive layers each having a light sensitive silver halide grain dispersibility of not less than 85%, (the above-mentioned light sensitive layers are sometimes abbreviated to 'the light sensitive layers of the invention'). From the viewpoint of the effects of the invention, it is particularly desired that at least one of the green and/or blue sensitive layers of the light sensitive materials is to be the light sensitive layer of the invention. When two or more same color sensitive layers each having the different light sensitivity, it is desired that the layer having the higher light sensitivity is to be the light sensitive layer of the invention.

It is particularly desired when all the green and/or blue sensitive layers are the light sensitive layers of the invention.

In the light sensitive layers of the invention, the light sensitive silver halide grain dispersibility is to be desirably not less than 85%, more desirably not less than 88% and particularly not less than 90%.

In the light sensitive silver halide grains contained in the light sensitive layers of the invention, 20% or more of all the whole projective areas thereof are to be constituted of silver halide grains having an aspect ratio of desirably not less than 3, more desirably not less than 40% and particularly not less than 60%.

In the silver halide grains having an aspect ratio of not less than 3, it is desirable when not less than 60% of all the grains in number are constituted of hexagonal tabular-shaped twinned crystal grains having a pair of twinned crystal planes comprising {111} faces parallel to each other. In particular, in the case of not less than 80%, it is more desirable.

Next, the typical means for embodying the invention will be detailed below.

The possibility of lowering the silver halide grain dispersibility may be considered such a coating thickness variation occurred when coating a light sensitive layer. However, the possibility of such a dispersibility lowering as mentioned above is very little in the ordinary production techniques applicable to the art. For example, on the cross-sectional photographs of any ordinary light sensitive materials being currently marketed, any variation of the light sensitive layer thickness cannot be observed as serious as the silver halide grain dispersibility is affected.

As another possibility to be considered, there is the possibilities of the cohesion and/or coalescense of light sensitive silver halide grains. The light sensitive layers of the invention can be prepared by making use of a silver halide emulsion prepared in the method describes later (hereinafter sometimes referred to as the silver halide emulsion relating to the invention). However, the present inventors conjecture that the light sensitive layers of the invention can be prepared because the above-mentioned grain cohesion and/or amalgamation can be inhibited.

It is, however, still not apparent what mechanism for enhancing the silver halide grain dispersibility operates to achieve the objects of the invention (particularly including the improvement of pressure resistance).

The silver halide emulsions relating to the invention can be prepared, for example, in at least a part of the grain forming stage where only the silver halide grains substantially having a fine grain size can be supplied to a mixing tank under the conditions of a mixing time for not shorter than 15 seconds.

The term, 'a mixing time', stated herein is synonymous with the term, 'a mixing time', commonly used in the chemical engineering field. It can be referred to the descriptions appeared in, for example, 'A Handbook of Chemical Engineering', (compiled by The Chemical Engineering Society; published by Maruzen Book Store).

The expression, 'Grains are formed by supplying only the substantially minute sized silver halide grains' (hereinafter sometimes abbreviated to silver halide fine grains), herein means that not less than 90% of silver ions and halide ions each for being applied to form the silver halide grains are supplied in the form of silver halide fine grains. When a solubility difference is exit between the supplied silver halide fine grains and the growing grains because of grain size difference, the supplied silver halide fine grains are dissolved and silver ions and halide ions are released to be supplied for the growing grains. Or when halide compositions are different between them, the increase of the entropy produced with uniforming the compositions is the driving force which dissolve the supplied silver halide fine grains.

The halide compositions of the silver halide fine grains to be supplied may be so selected as to be meet the halide compositions of any subject growing grains. It is also allowed to supply, at the same time, not less than two kinds of silver halide fine grains having the different halide compositions at any ratios so that a objective halide composition can be prepared.

The grain sizes of the silver halide fine grains are desirably not larger than 0.2 μm, more desirably not larger than 0.1 μm, still more desirably not larger than 0.05 μm and still further desirably 0.03 μm.

It is desired to supply the silver halide fine grains in the form of a silver halide finely grained emulsion suspended in a dispersion medium and the finely grains emulsions can also be subjected to a despairing treatment, if required.

In the silver halide emulsions relating to the invention and when the grains are formed by supplying the silver halide fine grains, it is preferred not less than 5% of total silver are supplied as the silver halide fine grains, more desirably not less than 10%, further desirably not less than 20% and still further desirably not less than 40%.

The mixing time is desirably not shorter than 15 seconds, more desirably within the range of not shorter than 15 seconds and not longer than 35 seconds and further desirably within the range of not shorter than 17 seconds and not longer than 30 seconds.

To the light sensitive layers of the silver halide color photographic light sensitive materials of the invention, every silver halide having any desired compositions can be applied. For example, it is allowed to use silver bromide, silver iodobromide, silver iodochlorobromide, silver chlorobromide, silver chloride or the mixtures thereof. Among them, however, it is preferable to use silver iodobromide having an average silver iodide content within the range of, desirably, 1 to 20 mol % and, more desirably, 2 to 15 mol %.

As for the silver halide emulsions applicable to the light sensitive layers of the light sensitive materials, it is desired to use a core/shell type emulsions having an iodine content higher in the core section than in the shell section thereof. When this is the case, it is desired to use a core/shell type emulsion comprising the core section having an iodine content within the range of not less than 15 mol % and not more than 40 mol %.

Among the core/shell type emulsions, a silver halide emulsion comprising the grains having an apparent core/shell structure, an emulsion comprising double-layer structured grains such as those given in JP OPI Publication No. 61-148442/1986 and an emulsion comprising multilayer structured grains such as those given in JP OPI Publication No. 61-245151/1986 are preferred.

The silver halide emulsions comprising the grains having the apparent core/shell structures, which are stated herein, can be clarified whether they are those or not in the X-ray diffracto-metric method detailed below.

Some examples of applying an X-ray diffractometry to silver halide grains are detailed in H. Hirsch, 'The Journal of Photographic Science', Vol.10, p.129 and so forth. In the examples, it is utilized that a diffraction peak is produced at a diffraction angle satisfying the Bragg's condition (that is, $2d \sin \theta = n\lambda$) when a lattice constant is determined by a silver halide composition.

The standard measurement methods in which the above-mentioned technique is utilized include a method in which Cu is used as a target and Kα rays of Cu is used as the ray source, and the diffraction pattern on the (420) faces of silver halide is measured at a tube voltage of 40 kV and a tube current of 100 mA in a powder X-ray diffractometry, so that the curve of the diffraction angles of a diffraction strength member. According the above-mentioned method, the expression, '- - - has an apparent core/shell structure - - - ', means the case where a diffraction curve substantially has two diffraction peaks.

The emulsions substantially having two diffraction peaks and an apparent core/shell structure as mentioned above include more desirably an emulsion comprising the grains each having an iodine content of which a single minimum point appears between a diffraction peak corresponding to a low iodine containing region and a diffraction signal peak corresponding to an internal high iodine containing region, and the strength of the diffraction peak corresponding to the high iodine containing region is so structured as to be 1/10 to 3/1 of the peak strength in the low iodine containing region.

The diffraction peak strength ratio is to be within the range of, more desirably, 1/5 to 3/1 and, further desirably, 1/3 to 3/1.

The other embodiments of the silver halide emulsions applicable to the light sensitive layers include, for example, an embodiment in which a silver iodide content is continuously varied from the center of a grain to the outside of the grain. In the above-mentioned case, it is desired that the silver iodide content of a grain is to be continuously reduced from a point having the maximum silver iodide content inside the grain to the outside of the grain. The silver iodide content of the maximum point is to be within the range of, desirably, 15 to 45 mol % and, more desirably, 25 to 40 mol %.

In any one of the above-described embodiments of the silver halide emulsions, the silver iodide contents of the surface phase of the silver halide grains thereof are to be, desirably, not more than 6 mol % and, more desirably, within the range of 0 to 4 mol %.

For improving the adsorption property of a sensitizing dye and the storage stability of a light sensitive material, it is possible that the grains have thin surface layer of high silver iodide content (i.e., not lower than 6 mol %).

In this case, the average thickness of the thin surface layer is, desirably, not thicker than 100 Å and, more distinctly, not thicker than 50 Å.

When applying to the light sensitive materials of the invention with an emulsion other than the silver halide emulsions relating to the invention, the other emulsions may be prepared in any one of the conventional preparation processes such as a single-jet process, a double-jet process and a controlled double-jet process. For efficiently preparing a monodisperse type core/shell emulsion, the controlled double-jet process is suitably applied.

Iodine can be supplied in, for example, a method in which iodine is supplied in the form of iodine ions by making use of an aqueous solution of alkali halide such as potassium iodide and sodium iodide, or in an aqueous solution of the mixture of the alkali halide solution and potassium bromide or sodium bromide; or another method such as those described in EP 323215 in which iodine is supplied in the form of AgI (silver iodide) fine grains. The latter method is preferred from the viewpoint that highly iodine containing cores can be efficiently and uniformly formed in the core/shell structures.

Among the silver halide grains applicable to the light sensitive layers of the silver halide color photographic light sensitive materials of the invention, those having a monodispersion property defined below are desirably used. As defined in Formula 2, the term, 'a monodispersion property', is defined when a standard deviation S of grain sizes is divided by an average grain size and the value obtained is multiplied by 100 (that is called a variation coefficient).

$$\text{Variation coefficient} = \frac{S}{\bar{r}} \times 100 \leqq 16\% \qquad \text{Formula 2}$$

wherein R=an average grain size

S represents a standard deviation in the general statistical sense.

The above-mentioned monodisperse type silver halide grains may be formed in a double layered structure or a multilayered structure, as described before.

The configuration of the monodisperse type silver halide grains may be regularly crystallized into a cube, octahedron or tetradecahedron, or crystallized into a spherical or tabular form. However, from the viewpoint that a light sensitive material having a more higher image quality can be prepared, monodisperse type tabular formed grains may preferably be used. From the viewpoint that a light sensitive material having a further higher speed can be prepared, these grains are particularly preferable to be hexahedral, tabular formed, monodisperse type grains.

The term, 'a grain size' stated herein means a diameter obtained when the projective image of a grain is converted into a circular image having the same area.

The grain size can be obtained in the manner that, for example, a grain is so projected as to be magnified 10,000 to 50,000 times through an electron microscope and the diameter of the printed grain image or the projected area thereof is practically measured, (provided that the numbers of the grains subject to the measurement are regarded to be not less than 1000 grains at random.)

The grain size measurement method is to be accorded to the above-described manner and the average grain size thereof is to be obtained in an arithmetical mean.

$$\text{Average grain size} = \Sigma d_1 n_1 / \Sigma n_1$$

An average grain size of the silver halide emulsions of the invention is to be within the range of, desirably, 0.1 to 10.0 μm, more desirably, 0.2 to 5.0 μm and, preferably, 0.3 to 3.0 μm.

When constituting the color photographic light sensitive materials of the invention, there uses a physically ripened, chemically ripened and spectrally sensitized silver halide emulsion. The additives applicable to the above-mentioned ripening and sensitizing steps are given in, for example, Research Disclosure Nos. 17643, 18716 and 308119 (hereinafter abbreviated to as RD 17643, 18716 and 308119, respectively).

The additives are given in the following places.

| [Additive] | [Page in RD308119] | [RD17643] | [RD18716] |
|---|---|---|---|
| Chemical sensitizer | 996 III-A | 23 | 648 |

-continued

| [Additive] | [Page in RD308119] | [RD17643] | [RD18716] |
|---|---|---|---|
| Spectral sensitizer | 996 IV-A-A, B, C, D, H, I, J | 23~24 | 648~649 |
| Supersensitizer | 996 IV-A-E, J | 23~24 | 648~649 |
| Antifoggant | 998 VI | 24~25 | 649 |
| Stabilizer | 998 VI | 24~25 | 649 |

When constituting the color photographic light sensitive materials of the invention, the known photographic additive applicable thereto are also given in the above-mentioned Research Disclosures. The places corresponding thereto will be given below.

| [Additive] | [Page in RD308119] | [RD17643] | [RD18716] |
|---|---|---|---|
| Color-stain inhibitor | 1002 VI-I | 25 | 650 |
| Dye-image stabilizer | 1001 VII-J | 25 | |
| Whitening agent | 998 V | 24 | |
| UV absorbent | 1003 VIII-C, XIII-C | 25~26 | |
| Light absorbent | 1003 VIII | 25~26 | |
| Light scattering agent | 1003 VIII | | |
| Filter dye | 1003 VIII | 25~26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator, coating aid | 1005 XI | 26~27 | 650 |
| Matting agent | 1007 XVI | | |
| Developing agent (containing a light sensitive material) | 1011 XX-B | | |

When constituting the color photographic light sensitive materials of the invention, various types of couplers may be used. The typical examples thereof are also given in the above-given Research Disclosures. The places corresponding thereto will be given below.

| [Coupler] | [Page in RD308119] | [RD17643] |
|---|---|---|
| Yellow coupler | 1001 VII-D | VII-C~G |
| Magenta coupler | 1001 VII-D | VII-C~G |
| Cyan coupler | 1001 VII-D | VII-C~G |
| Colored coupler | 1002 VII-G | VII-G |
| DIR coupler | 1001 VII-F | VII-F |
| BAR coupler | 1002 VII-F | |
| Other useful residual group | | |
| Releasing coupler | 1001 VII-F | |
| Alkali-soluble coupler | 1001 VII-E | |

When constituting the color photographic light sensitive materials of the invention, the additives applicable thereto can be added in the dispersion processes described in, for example, RD 308119, XIV.

When constituting the color photographic light sensitive materials of the invention, the supports detailed in, for example, the above-given RD 17643, p.28; RD 18716, pp.647~648 and RD 308119, XVII can be used.

The color photographic light sensitive materials of the invention can be provided with an auxiliary layer including, for example, a filter layers and an interlayer, detailed in the above-given RD 308119, VII-K.

The color photographic light sensitive materials of the invention may have various layer arrangements including, for example, a conventional layer arrangement, an inverted layer arrangement and a unit layer arrangement, of which detailed in, for example, RD 308119, VII-K.

The color photographic light sensitive materials of the invention may suitably be applied to various types of color photographic light sensitive materials typified by, for example, a color negative film for general or cinematographic use, a color reversal film for slide or TV use, a color paper, a color positive film and a color reversal paper.

The color photographic light sensitive materials of the invention may be developed in any ordinary methods including, for example, those detailed in RD 17643, pp.28~29; RD 18716, p.615 and RD 308119, XIX.

EXAMPLES

The typical examples of the invention will now be detailed. However, the embodiments of the invention shall not be limited thereto.

Example 1

Figure 2:
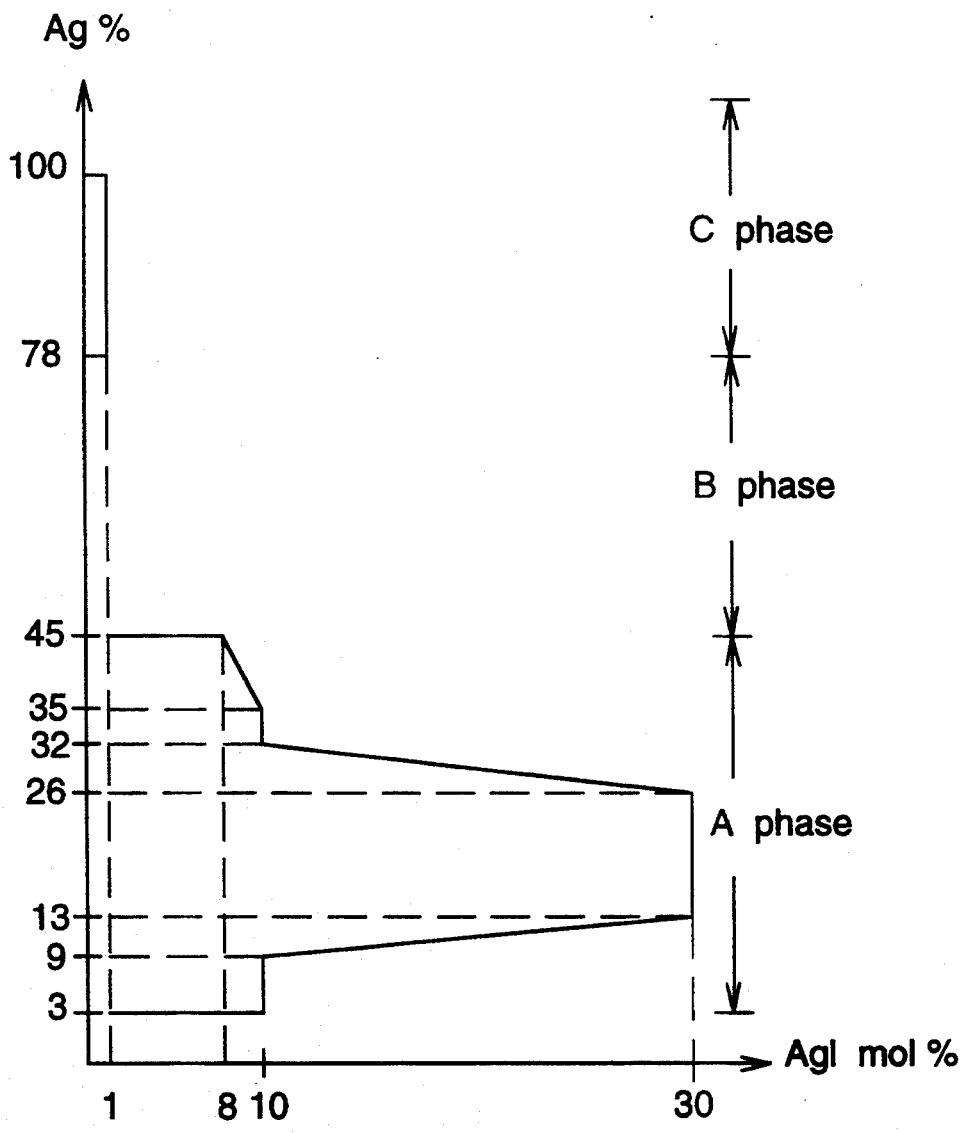
FIG. 2 is the structural illustration of a silver halide composition.

Silver iodobromide emulsions [EM-11] through [EM-16] having the structures of silver halide composition such as that shown in FIG. 2.

The emulsion preparation processes will be detailed below.

<Preparation of octahedral, regular crystallized, monodisperse type emulsion [EM-11] : a comparative emulsion>

A silver iodobromide emulsion was prepared by making use of silver iodobromide grains (having a silver iodide content of 1 mol %) which had an average grain size of 0.30 μm, but did not have any twinned crystals so as to serve as the seed crystals thereof.

Solution <G-10> contained in a reaction chamber was kept at a temperature of 70° C., a pAg of 7.8 and a pH of 7.2 and was then added with a seed emulsion in an amount equivalent to 0.286 mols while it was being stirred.

After then, <H-10>, <S-10> and <MC-10> were each acceleratingly added into a reaction chamber at a flow rate required for constituting the silver halide composition shown in FIG. 2 by taking a time for 110 minutes in a triple-jet process, so that a core phase (called A phase) could be formed. In the above-mentioned courses, the pAg and pH thereof were controlled to be 7.8 and 7.2, respectively.

Successively, <H-10> and <S-10> were acceleratingly added into the reaction chamber by taking a time for 15 minutes in a double-jet process, while controlling the pAg and pH to be 9.4 and 6.5, respectively, so that the first shell phase (called Phase B) could be formed.

After then, <H-10>, <S-10> and <MC-10> were each acceleratingly added into a reaction chamber at a flow rate required for constituting the silver halide composition shown in FIG. 2 by taking a time for 10 minutes in a triple-jet process, so that the second shell phase (called Phase C) could be formed. In the above-mentioned courses, the pAg thereof was varied continuously from 9.4 and 9.7.

In the courses of forming the phases, each of the average mixing time was controlled as shown in Table 1.

For controlling each of the pAg and pH in the course of growing grains, an aqueous potassium bromide solution and an aqueous acetic acid solution were used.

After forming the grains, a washing treatment was carried out in the method described in Japanese Patent Application (hereinafter referred to as JP Application) No. 2-4003/1990. After that, the grains were redispersed by adding gelatin and the pH and pAg thereof were adjusted to be 5.8 and 8.06 at 40° C., respectively.

From the SEM photograph (standing for a scanning type electron microscopic photograph) of the resulting emulsion grains, it was confirmed the the emulsion was a regularly crystallized monodisperse type emulsion having a variation coefficient of 10.3%.

The resulting emulsion is named [EM-11].

<Preparation of Octahedral regular crystallized emulsion [EM-12]: a comparative emulsion>

[EM-12] was prepared in almost the same manner as in [EM-11].

In the preparation thereof, each of the average mixing time in the course of forming Phase C was controlled to have the values shown in Table 1.

There obtained a regularly crystallized emulsion having an average grain size of 1.1 μm (i.e., an average grain size of 1.0 μm obtained when converting the grains into spheres) and a variation coefficient of 18.7%. The reason why the variation coefficient was deteriorated may be probably that the average mixing time was prolonged (or that the stirring efficiency was lowered.).

<Preparation of octahedral regularly crystallized monodisperse type emulsion [EM-13]: a comparative emulsion>

[EM-13]was prepared in almost the same manner as in [EM-11].

In the preparation thereof, Phase C was formed by supplying <MC-11>.

There obtained a regularly crystallized monodisperse type emulsion having an average grain size of 1.1 μm (i.e., an average grain size of 1.0 μm obtained when converting the grains into spheres) and a variation coefficient of 10.0%.

<Preparation of octahedral regularly crystallized monodisperse type emulsion [EM-14]: a comparative emulsion>

[EM-14]was prepared in almost the same manner as in [EM-11].

In the preparation thereof, Phase C was formed by supplying <MC-11> and the average mixing time in the course of forming Phase C was controlled as shown in Table 1.

There obtained a regularly crystallized monodisperse type emulsion having an average grain size of 1.1 μm (i.e., an average grain size of 1.0 μm obtained when converting the grains into spheres) and a distribution range of 10.0%.

<Preparation of octahedral regularly crystallized monodisperse type emulsion [EM-15]: an inventive emulsion>

[EM-15] was prepared in almost the same manner as in [EM-14].

In the preparation thereof, the average mixing time in the course of forming Phase C was controlled as shown in Table 1.

There obtained a regularly crystallized monodisperse type emulsion having an average grain size of 1.1 μm (i.e., an average grain size of 1.0 μm obtained when converting the grains into spheres) and a variation coefficient of 9.8%.

<Preparation of octahedral regularly crystallized monodisperse type emulsion [EM-16]: an inventive emulsion>

[EM-16] was prepared in almost the same manner as in [EM 14].

In the preparation thereof, Phases B and C were each formed by supplying <MC-12> and <MC-11>, and the average mixing time in the course of forming both Phases were controlled as shown in Table 1.

There obtained a regularly crystalized disperse type emulsion having an average grain size of 1.1 μm (i.e., an average grain size of 1.0 μm obtained when converting the grains into spheres) and a variation coefficient of 9.5%.

TABLE 1

| | Average mixing time controlled value | | |
|---|---|---|---|
| Emulsion | Phase A | Phase B | Phase C |
| EM-11 | 11 sec | 11 sec | 11 sec |
| EM-12 | 11 sec | 11 sec | 18 sec |
| EM-13 | 11 sec | 11 sec | 11 sec |
| EM-14 | 11 sec | 11 sec | 14 sec |
| EM-15 | 11 sec | 11 sec | 16 sec |
| EM-16 | 11 sec | 18 sec | 18 sec |

| | |
|---|---|
| <G-10> | |
| Ossein gelatin (with a molecular weight of 100, 000) | 262.5 g |
| An aqueous 28% ammonia solution | 528.0 ml |
| An aqueous 56% acetic acid solution | 795.0 ml |
| A methanol solution containing 0.001 mol of $I_2$ | 50.0 ml |
| Add water to make | 4450.0 ml |
| <H-10> | |
| An aqueous 3.5N potassium bromide solution containing 4.5 wt % of gelatin | |
| <S-10> | |
| An aqueous 3.5N ammoniacal silver nitrate solution (having a pH 9.8 controlled with ammonium nitrate) | |
| <MC-10> | |
| A finely grained emulsion comprising 3 wt % of gelatin and silver iodide grains (having an average grain size of 0.04 μm) | |

How to prepare will be given below.

Each of 2000 ml of an aqueous solution containing 7.06 mols of silver nitrate and 2000 ml of an aqueous solution containing 7.06 mols of potassium iodide were added by taking a time for 10 minutes into 5000 ml of a 6.0 wt % gelatin solution containing 0.06 tools of potassium iodide.

In the course of forming the fine grains, the pH thereof was controlled to be 2.0 with the use of nitric acid at 40° C.

After forming the fine grains, the pH was adjusted to be 6.0 with an aqueous sodium carbonate solution.

<MC-11>

A finely grained emulsion comprising silver iodobromide grains (having an average grain size of 0.03 μm) containing 1 mol % of silver iodide, which was prepared in the same manner as in <MC-10>

(wherein the temperature in the course of forming the fine grains was controlled to be at 28° C.)

<MC-12>

A finely grained emulsion comprising silver bromide grains (having an average grain size of 0.03 μm), which was prepared in the same manner as in <MC-11>

<MC-13>

A finely grained emulsion comprising silver iodobromide grains (having an average grain size of 0.03 μm) containing 5 mol % of silver iodide, which was prepared in the same manner as in <MC-11>

<Preparation of silver halide color photographic light sensitive material [Sample-11]>

The multi layered color photographic light sensitive material samples were prepared in the following manner. Each of emulsions [EM-11] through [EM-16] was subject to an optimum gold sulfur sensitization and spectral sensitization and the resulting emulsions were coated onto a triacetyl cellulose film support so as to provide each of the layers having the following compositions, respectively.

The compositions of multilayered color photographic light sensitive material [Sample-11] were as follows.

The amounts of the materials added to the light sensitive material are indicated by grams per sq.meter unless otherwise expressly stated. The amounts of silver halides and colloidal silver are indicated upon converting them into the corresponding silver contents. The amounts of the sensitizing dyes added are indicated by mol numbers per mol of silver halide used.

| | |
|---|---|
| Layer 1: an antihalation layer | |
| Black colloidal silver | 0.16 |
| UV absorbent (UV-1) | 0.20 |
| High boiling point organic solvent (Oil-1) | 0.16 |
| Gelatin | 1.23 |
| Layer 2: an interlayer | |
| Compound (SC-1) | 0.15 |
| High boiling point organic solvent (Oil-2) | 0.17 |
| Gelatin | 1.27 |
| Layer 3: a low-speed red-sensitive layer | |
| A silver iodobromide emulsion, (having an average grain size of 0.38 μm and a silver iodide content of 8.0 mol %) | 0.50 |
| A silver iodobromide emulsion, (having an average grain size of 0.27 μm and a silver iodide content of 2.0 mol %) | 0.21 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-5}$ |
| Sensitizing dye (SD-4) | $1.0 \times 10^{-4}$ |
| Cyan coupler (C-1) | 0.48 |
| Cyan coupler (C-2) | 0.14 |
| Colored cyan coupler (CC-1) | 0.021 |
| DIR compound (D-1) | 0.020 |
| High boiling point organic solvent (Oil-1) | 0.53 |
| Gelatin | 1.30 |
| Layer 4: a medium-speed red-sensitive layer | |
| A silver iodobromide emulsion, (having an average grain size of 0.52 μm and a silver iodide content of 8.0 mol %) | 0.62 |
| A silver iodobromide emulsion, (having an average grain size of 0.38 μm and a silver iodide content of 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling point organic solvent (Oil-1) | 0.30 |
| Gelatin | 0.93 |
| Layer 5: a high-speed red-sensitive layer | |
| [EM-11] | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling point organic solvent (Oil-1) | 0.14 |
| Gelatin | 0.91 |
| Layer 6: an interlayer | |
| Compound (SC-1) | 0.09 |
| High boiling point organic solvent (Oil-2) | 0.11 |
| Gelatin | 0.80 |

-continued

| | |
|---|---|
| Layer 7: a low-speed green-sensitive layer | |
| A silver iodobromide emulsion, (having an average grain size of 0.52 μm and a silver iodide content of 8.0 mol %) | 0.61 |
| A silver iodobromide emulsion, (having an average grain size of 0.27 μm and a silver iodide content of 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling point organic solvent (Oil-2) | 0.75 |
| Gelatin | 1.95 |
| Layer 8: a medium-speed green-sensitive layer | |
| A silver iodobromide emulsion, (having an average grain size of 0.5987 and a silver iodide content of 8.0 mol %) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-3) | 0.002 |
| High boiling point organic solvent (Oil-2) | 0.50 |
| Gelatin | 1.00 |
| Layer 9: a high-speed green-sensitive layer | |
| [EM-11] | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |
| Colored magenta coupler (CM-1) | 0.012 |
| High boiling point organic solvent (Oil-1) | 0.27 |
| High boiling point organic solvent (Oil-2) | 0.012 |
| Gelatin | 1.00 |
| Layer 10: a yellow filter layer | |
| Yellow colloidal silver | 0.08 |
| Color-stain inhibitor (SC-2) | 0.15 |
| Formalin scavenger (HS-1) | 0.20 |
| High boiling point organic solvent (Oil-2) | 0.19 |
| Gelatin | 1.10 |
| Layer 11: an interlayer | |
| Formalin scavenger (HS-1) | 0.20 |
| Gelatin | 0.60 |
| Layer 12: a low-speed blue-sensitive layer | |
| A silver iodobromide emulsion, (having an average grain size of 0.38 μm and a silver iodide content of 8.0 mol %) | 0.22 |
| A silver iodobromide emulsion, (having an average grain size of 0.27 μm and a silver iodide content of 2.0 mol %) | 0.03 |
| Sensitizing dye (SD-8) | $4.9 \times 10^{-4}$ |
| Yellow coupler (Y-1) | 0.75 |
| DIR compound (D-1) | 0.010 |
| High boiling point organic solvent (Oil-2) | 0.30 |
| Gelatin | 1.20 |
| Layer 13: a medium-speed blue-sensitive layer | |
| A silver iodobromide emulsion, (having an average grain size of 0.59 μm and a silver iodide content of 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| DIR compound (D-1) | 0.010 |
| High boiling point organic solvent (Oil-2) | 0.046 |
| Gelatin | 0.47 |
| Layer 14: a high-speed blue-sensitive layer | |
| [EM-11] | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling point organic solvent (Oil-2) | 0.046 |
| Gelatin | 0.80 |
| Layer 15: a protective layer | |
| A silver iodobromide emulsion, (having an average grain size of 0.08 μm and a silver iodide content of 1.0 mol %) | 0.40 |
| UV absorbent (UV-1) | 0.065 |

-continued

| | |
|---|---|
| UV absorbent (UV-2) | 0.10 |
| High boiling point organic solvent (Oil-1) | 0.07 |
| High boiling point organic solvent (Oil-3) | 0.07 |
| Formalin scavenger (HS-1) | 0.40 |
| Gelatin | 1.31 |
| Layer 16: The 2nd protective layer | |
| Alkali-soluble matting agent (having an average particle size of 2 μm) | 0.15 |
| Polymethyl methacrylate (having an average particle size of 3 μm) | 0.04 |
| Lubricant (WAX-1) | 0.04 |

-continued

| | |
|---|---|
| Gelatin | 0.55 |

Besides the above-given compositions, coating aid Su-1, dispersion aid Su-2, a viscocity controller, layer hardeners H-1 and H-2, stabilizer ST-i, antifoggant AF-1, two kinds of AF-2 having respectively the weight average molecular weights of 10,000 and 1,100,000, and antiseptic DI-1 were each added thereto. The amount of DI-1 added thereto was 9.4 mg/m$^2$.

The structures of the compounds used in the above-described samples were as follows.

C-1

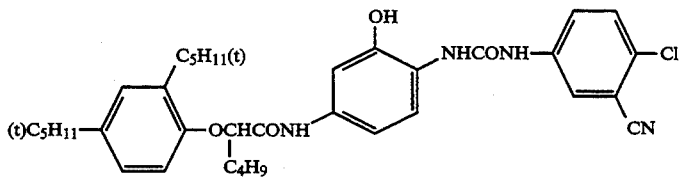

C-2

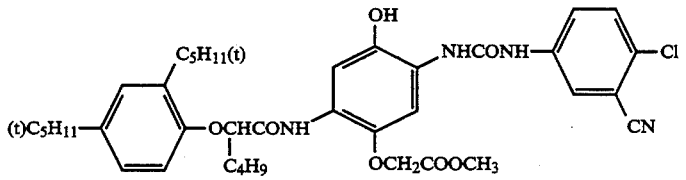

M-1

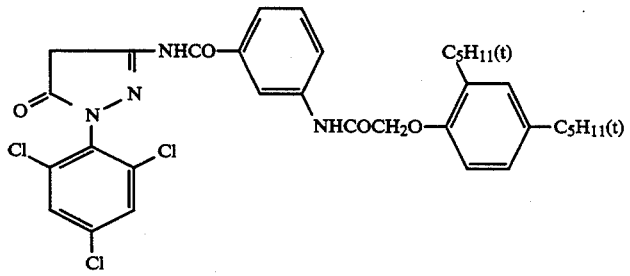

M-2

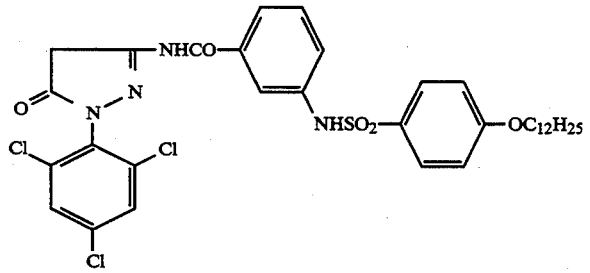

M-3

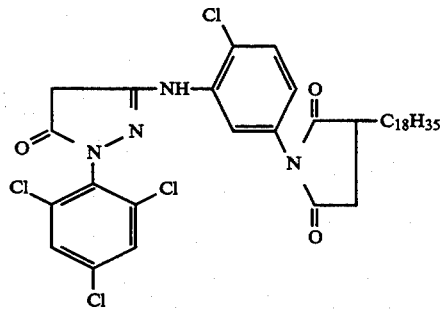

-continued
Y-1
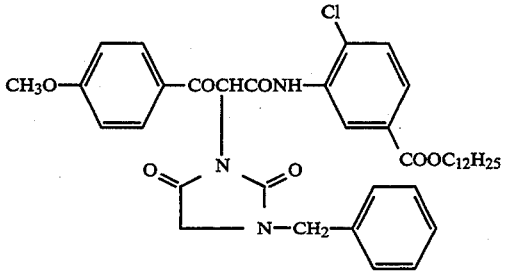
CC-1
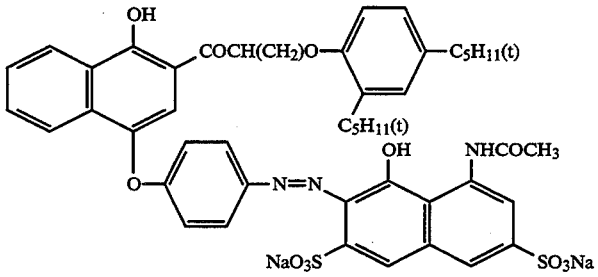
CM-1
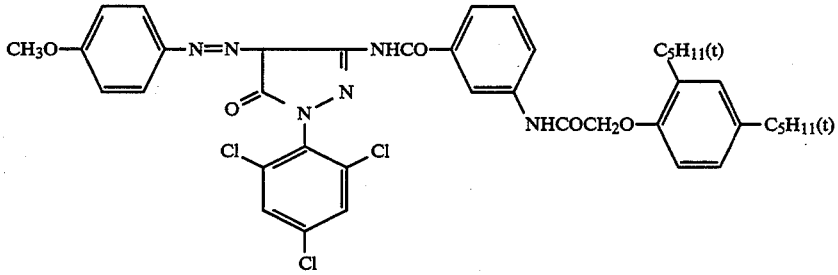
D-1
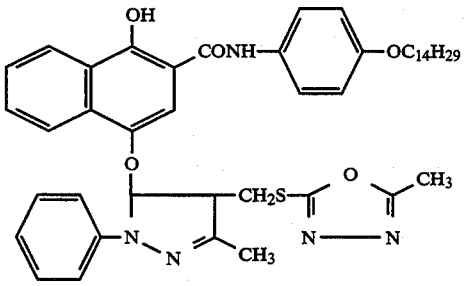
D-2
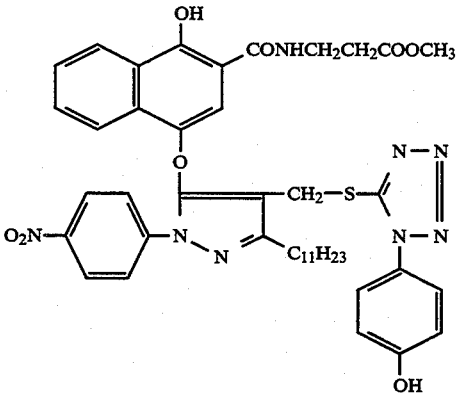

-continued
D-3
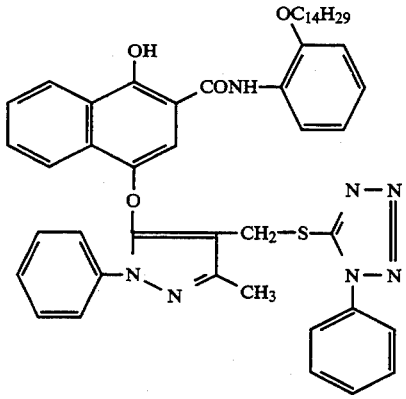
Oil-1
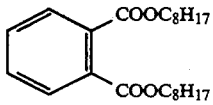
Oil-2
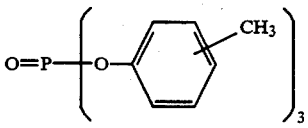
Oil-3
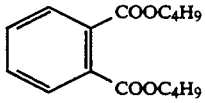
SC-1
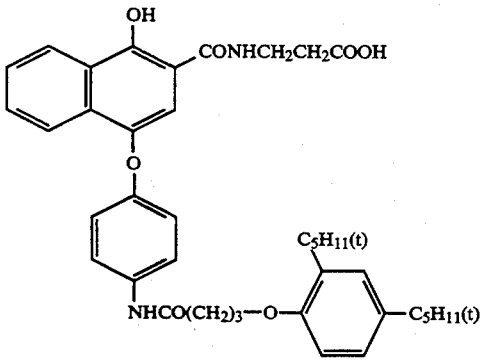
SC-2
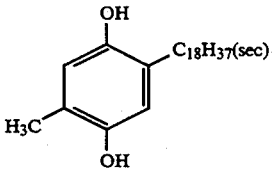
UV-1
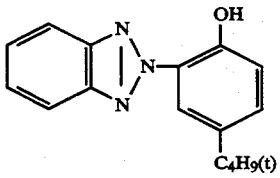
UV-2
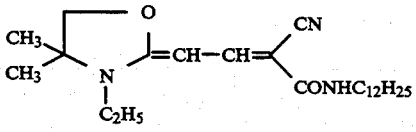

-continued
WAX-1
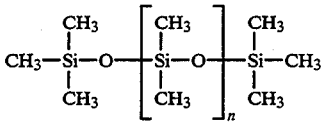
Weight average molecular weight MW: 3,000
Su-1
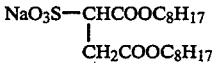
Su-2
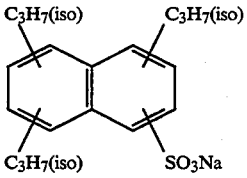
HS-1
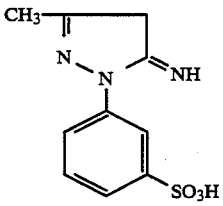
SD-1
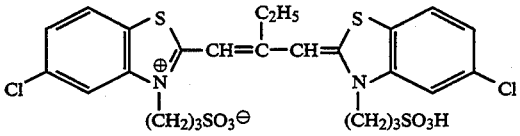
SD-2
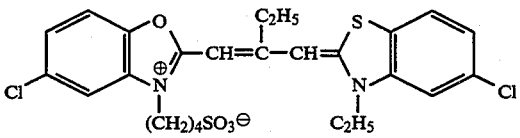
SD-3
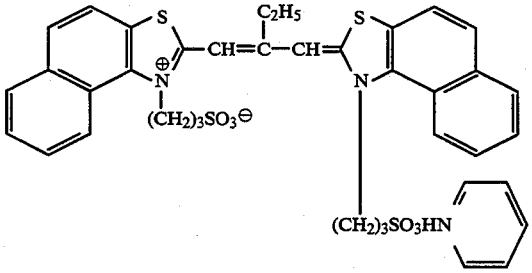
SD-4
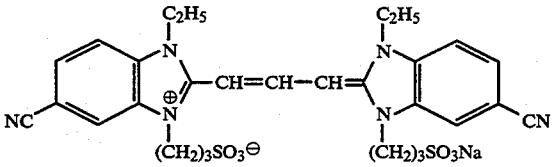
SD-5
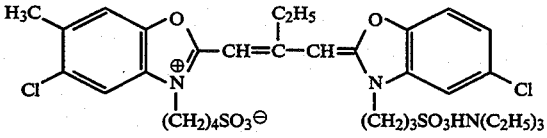

-continued
SD-6
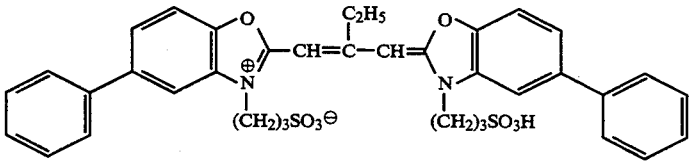
SD-7
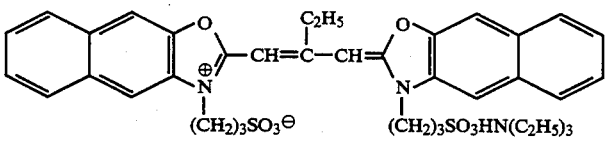
SD-8
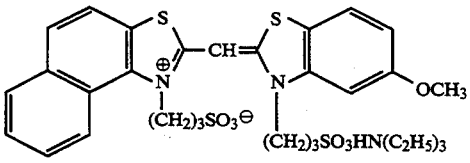
SD-9
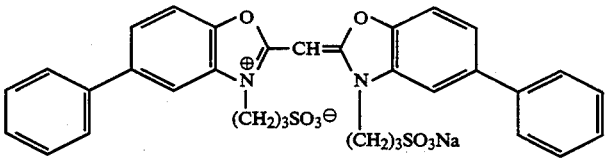
H-1
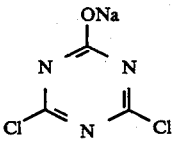
$(CH_2{=}CHSO_2CH_2)_2O$ H-2
ST-1
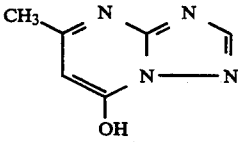
AF-1
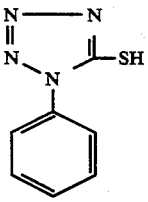
AF-2
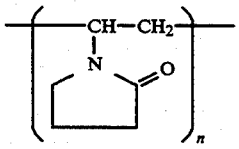
n: polymerization degree
(A mixture of the following 3 compositions)
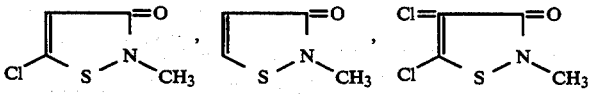
(Composition A) (Composition B) (Composition C)

-continued

Composition A : Composition B : Composition C = 50:46:4 (in mol ratio)

Next, each of [Sample-12] through [Sample-16] was prepared by making use of [EM-12] through [EM-16]in place of silver halide emulsion [EM-11] used in layers 5, 9 and 14 of the above-described [Sample-11].

The electron microscopic photographs of the cross-section of each of the resulting samples were taken so as to obtain the dispersibilities of the silver halide grains contained in layers 5, 9 and 14 of each sample. The results thereof are shown in Table 2.

TABLE 2

| Sample No. | Layer 5 | Layer 9 | Layer 14 |
|---|---|---|---|
| Sample-11 | 71% | 73% | 73% |
| -12 | 72% | 74% | 73% |
| -13 | 76% | 77% | 77% |
| -14 | 79% | 80% | 79% |
| -15 | 86% | 88% | 87% |
| -16 | 91% | 93% | 92% |

Immediately after the samples were prepared, each of the samples was exposed to white light through a wedge and was then developed in the following processing steps.

For the purpose of evaluating the pressure resistance characteristics of each sample, each of the samples was bent along the cylindrical pole having a diameter of 4 mm or a pressure was applied each sample by scratching them with a 7 g-weight loaded diamond needle having a curvature diameter of 0.025 mm and the scratched samples were each exposed to light and developed in the same manner. The processing steps were as follows.

| Processing steps | | |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24~41° C. |
| 4. Fixing | 6 min. 30 sec. | 38.0 ± 3.0° C. |
| 5. Washing | 3 min. 15 sec. | 24~41° C. |
| 6. Stabilizing | 3 min. 15 sec. | 38.0 ± 3.0° C. |
| 7. Drying | | Not higher than 50° C. |

The compositions of the processing solutions used in the above-mentioned processing steps were as follows.

| | |
|---|---|
| <Color developer> | |
| 4-amino-3-methyl-N-ethyl-N-(β-hydroxyethyl)aniline.sulfate | 4.75 g |
| Sodium sulfite, anhydrous | 4.25 g |
| Hydroxylamine.½sulfate | 2.0 g |
| Potassium carbonate, anhydrous | 37.5 g |
| Sodium bromide | 1.3 g |
| Trisodium nitrilotriacetate, (monohydrate) | 2.5 g |
| Potassium hydroxide | 1.0 g |
| Add water to make | 1 liter |
| Adjust pH to be | pH = 10.0 |
| <Bleacher> | |
| Iron ammonium ethylenediamine tetraacetate | 100.0 g |

DI-1

-continued

| | |
|---|---|
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | pH = 6.0 |
| <Fixer> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH = 6.0 |
| <Stabilizer> | |
| Formalin (in an aqueous 37% solution) | 1.5 ml |
| Konidux (manufactured by Konica Corp.) | 7.5 ml |
| Add water to make | 1 liter |

With the resulting samples, the relative fogginess, relative sensitivity, relative RMS value and density variation in the pressure applied portions were each measured by making use of red (R), green (G) and blue (B) lights, respectively. The results thereof are shown in Table 3.

The relative fog density is a value relative to the minimum density (Dmin), and the values thereof are indicated by a value 100 times as much as the Dmin value of [Sample-11].

The relative sensitivity is a value relative to the reciprocal of an exposed quantity providing a density of Dmin+0.15 and the values thereof are indicated by a value 100 times as much as the sensitivity value of [Sample-11].

The relative RMS value is measured at a density point of Dmin+0.15 where is the same point for measuring the above-mentioned relative sensitivity, and the relative RMS values are indicated by a value 100 times as much as the RMS value of [Sample-11]. It is meant that the smaller the values are, the more the graininess is excellent. The RMS values were measured in the method described in JP Application No. 3-134970/1991.

The density variations in the portions applied with a pressure were indicated by a value 100 times as much as the value of [Sample-11] after measuring the density variation values of each samples by a microdensitometer at a density point of Dmin+0.15 and in accordance with Formula 3. When a density of the portion applied with a pressure is increased more than in the portion not applied with any pressure, a plus mark was indicated in Table 3 and, when a density thereof is decreased, a minus mark was indicated therein.

Density variation at pressurized portion = Formula 3

$$\frac{(\text{Density of a pressurized portion} - \text{Density of a unpressurized portion})}{0.15} \times 100\ (\%)$$

TABLE 3

| Sample No. | Color sensitive layer | Relative fog density | Relative sensitivity | Relative RMS | Relative density variation at the pressurized portions: Bent portion | Relative density variation at the pressurized portions: Scratched portion |
|---|---|---|---|---|---|---|
| Sample-11 | Red (R) | 100 | 100 | 100 | −100 | +100 |

TABLE 3-continued

| Sample No. | Color sensitive layer | | Relative fog density | Relative sensitivity | Relative RMS | Relative density variation at the pressurized portions: Bent portion | Relative density variation at the pressurized portions: Scratched portion |
|---|---|---|---|---|---|---|---|
| (Comparative | Green | (G) | 100 | 100 | 100 | −100 | +100 |
| example) | Blue | (B) | 100 | 100 | 100 | −100 | +100 |
| Sample-12 | Red | (R) | 102 | 76 | 142 | −121 | +133 |
| (Comparative | Green | (G) | 98 | 83 | 137 | −127 | +135 |
| example) | Blue | (B) | 100 | 79 | 134 | −132 | +141 |
| Sample-13 | Red | (R) | 88 | 112 | 98 | −84 | +88 |
| (Comparative | Green | (G) | 83 | 114 | 95 | −87 | +91 |
| example) | Blue | (B) | 85 | 114 | 97 | −88 | +93 |
| Sample-14 | Red | (R) | 87 | 114 | 97 | −82 | +85 |
| (Comparative | Green | (G) | 84 | 117 | 94 | −86 | +89 |
| example) | Blue | (B) | 84 | 116 | 92 | −86 | +90 |
| Sample-15 | Red | (R) | 84 | 123 | 84 | −36 | +41 |
| (Inventive | Green | (G) | 79 | 129 | 79 | −29 | +37 |
| example) | Blue | (B) | 82 | 128 | 76 | −28 | +34 |
| Sample-16 | Red | (R) | 81 | 132 | 79 | −17 | +22 |
| (Inventive | Green | (G) | 74 | 136 | 75 | −9 | +13 |
| example) | Blue | (B) | 77 | 138 | 70 | −9 | +11 |

From the results shown in Table 3, it was proved that the photographic light sensitive materials of the invention can be low in fog density, high in sensitivity, excellent in graininess and capable of showing the excellent pressure resistance characteristics. The more effects can particularly be displayed when a green and/or blue sensitive layer is a light sensitive layer of the invention.

Example-2

Silver iodobromide emulsions [EM-21] through [EM-24] were each prepared. Each of the emulsion preparation processes will be detailed below.

<Preparation of octahedral, twinned crystal, monodisperse type emulsion [EM-21]: an emulsion relating to the invention>

Figure 3:
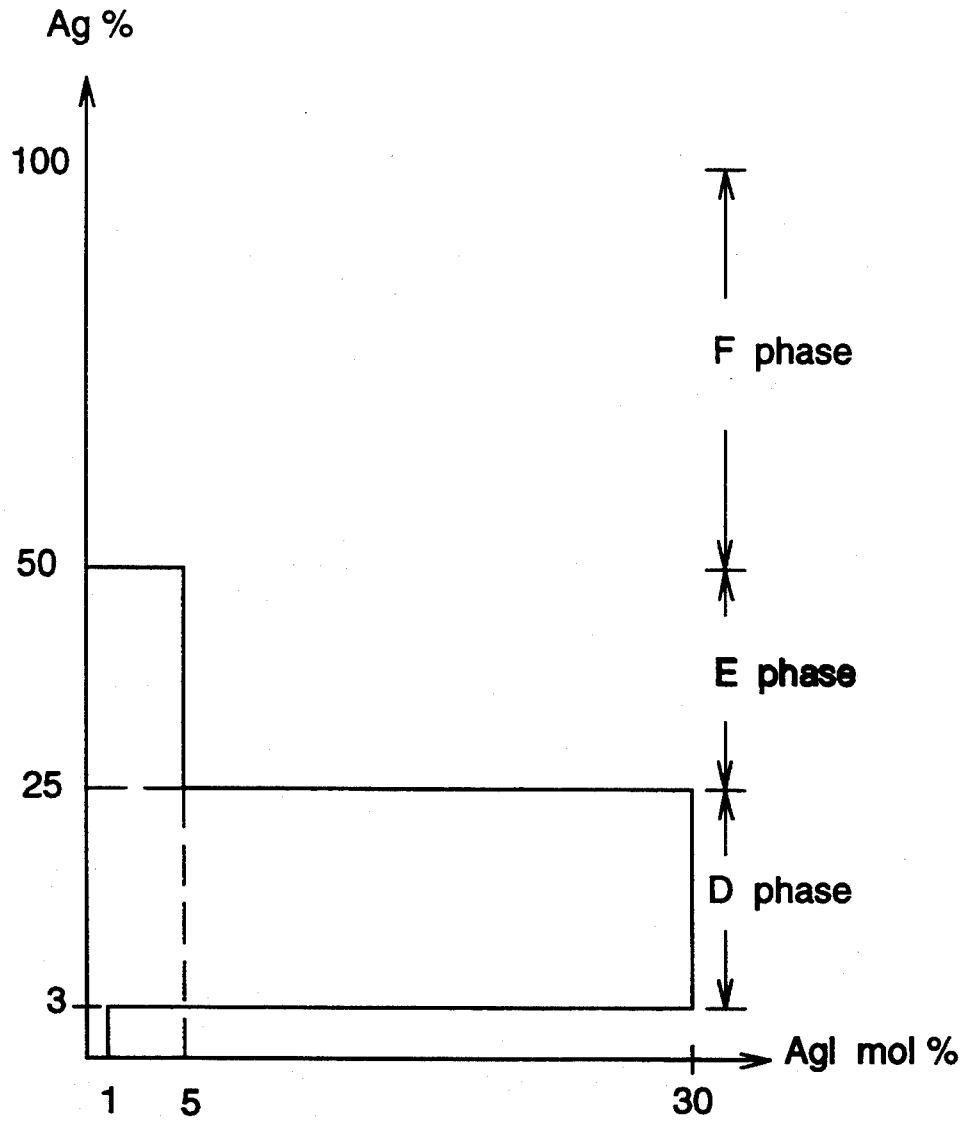
FIG. 3 is the structural illustration of another silver halide composition; wherein a indicates the dried layer thickness of a light sensitive layer; and b indicates the length 10 times as long as the dried layer thickness of a light sensitive layer.

Globular-shaped silver iodobromide grains (having a silver iodide content of 1 mol %), which had each two twinned crystal faces parallel to each other and having an average grain size of 0.30 μm, were used as the seed crystals, so that a silver iodobromide emulsion having the structure of such a silver halide composition as shown in FIG. 3 could be prepared.

While keeping solution <G-10> contained in a reaction chamber at a temperature of 70° C., a pAg of 7.8 and a pH of 7.2 and stirring the solution well, the seed emulsion was added in an amount equivalent to 0.286 mols thereinto.

After that, <H-10> and <S-10>, and <MC-10> were acceleratingly added into the reaction chamber by taking a time for 120 minutes in a triple-jet method, so that a core phase (called Phase D) could be formed. In the course of forming Phase D, the pAg, pH and average mixing time were controlled to be 7.8, 7.2 and 11 seconds, respectively.

Successively, while controlling the pAg and pH to be 9.4 and 6.5, respectively, <MC-13> was acceleratingly added into the reaction chamber by taking a time for 30 minutes, so that the first shell phase (called Phase E) could be formed.

Further successively, <MC-12> was acceleratingly added into the reaction chamber by taking a time for 20 minutes, so that the second shell phase (called Phase F) could be formed. In the course of forming Phase F, the pAg was continuously varied from 9.4 to 9.7. The average mixing time of Phase F and that in the courses of forming Phases F were each controlled to be 18 seconds.

In the course of growing the grains, the pAg and pH thereof were controlled by making use of an aqueous potassium bromide solution and an aqueous acetic acid solution, respectively.

After forming the grains, they were washed in accordance with the method described in JP Application No. 2-4003/1990 and were then redispersed by adding gelatin. The pH and pAg thereof were controlled to be 5.8 and 8.06 at a temperature of 40° C.

From the SEM photograph (i.e., the scanning type electron microscopic photograph) of the resulting emulsion grains, it was confirmed that the resulting emulsion was a twinned crystal monodisperse type emulsion having an average grain size of 1.1 μm (or a grain size of 1.0 μm which was obtained by converting the grain configuration into the spheres) and a variation coefficient of 10.3%.

The resulting emulsion was called [EM-21]

<Preparation of tabular-shaped, twinned crystal, monodisperse type emulsion [EM-22]: an emulsion relating to the invention>

[EM-22] was prepared in almost the same manner as in [EM-21], provided, wherein the pAg thereof in the course of forming Phase D was controlled to be 8.4.

A hexagonal, tabular-shaped, monodisperse type emulsion could be so prepared as to have an average grain size of 1.23 μm (or a 1.0 μm obtained by converting the grain configuration into the spheres), an aspect ratio thereof was 2.8 and the variation coefficient of 12.1%.

<Preparation of tabular-shaped, twinned crystal, monodisperse type emulsion [EM-23]: an emulsion relating to the invention>

[EM-23]was prepared in almost the same manner as in [EM-21], provided, wherein the pAg thereof in the course of forming Phase D was controlled to be 8.8.

A hexagonal, tabular-shaped, monodisperse type emulsion could be so prepared as to have an average grain size of 1.29 μm (or a 1.0 μm obtained by converting the grain configuration into the spheres), an aspect ratio thereof was 3.2 and the variation coefficient of 12.7%.

<Preparation of tabular-shaped, twinned crystal, monodisperse type emulsion [EM-24]: an emulsion relating to the invention>

[EM-24]was prepared in almost the same manner as in [EM-21], provided, wherein the pAg thereof in the course of forming Phase D was controlled to be 9.2 and the pAg of Phase E and that in the course of forming Phase F were each continuously varied from 94. to 10.1, respectively.

A hexagonal, tabular-shaped, monodisperse type emulsion could be so prepared as to have an average grain size of 1.50 μm (or a 1.0 μm obtained by converting the grain configuration into the spheres), an aspect ratio thereof was 5.1 and the variation coefficient of 13.9%.

Each of emulsions [EM-21] through [EM-24] was subject to the optimum gold sulfur sensitization and spectral sensitization. By making use of the resulting emulsions in Layers 14 (i.e., the blue sensitive layers), the multilayered color photographic light sensitive material [Sample-21]through [Sample-24] were each prepared in the same manner as in Example-1 and the samples were then evaluated.

When taking the electron microscopic photographs of the cross-sections of the resulting samples and checking up the dispersibilities of the silver halide grains in Layers 14 of each sample, it was confirmed that every sample was proved to have a dispersibility of not less than 85% and that the samples were the photographic light sensitive materials of the invention.

With each sample, the relative fog density, relative sensitivity, relative RMS value and relative density variations in the pressurized portions thereof were measured by making use of blue light (B) . The results thereof are shown in Table 4.

TABLE 4

| Sample No. | Relative fog density | Relative sensitivity | Relative RMS | Relative density variation at the pressurized portions: Bent portion | Relative density variation at the pressurized portions: Scratched portion |
|---|---|---|---|---|---|
| Sample-21 | 100 | 100 | 100 | −100 | +100 |
| Sample-22 | 99 | 113 | 100 | −98 | +100 |
| Sample-23 | 98 | 123 | 101 | −82 | +83 |
| Sample-24 | 101 | 134 | 104 | −65 | +72 |

From the results shown in Table 4, it was proved that the effects of the invention can be particularly remarkable when the light sensitive layers of the invention are comprised of tabular-shaped grains having an aspect ratio of not less than 3.

The effects of the invention could be confirmed when a multilayered color photographic light sensitive material was prepared in the same manner except that emulsions [EM-21] through [EM-24]were each used in Layers 5 (or, the red sensitive layers) or Layers 9 (or the green sensitive layers), and when they were evaluated.

Example 3

<Preparation of [EM-31]through [EM-36]>

[EM-21]and [EM-23]were mixed up together at the proportions shown in Table 5, so that [EM-31]through [EM-36]could be prepared.

TABLE 5

| Emulsion No. | Emulsion [EM-21] | proportion [EM-23] | Grain area ratio at an aspect ratio ≧3 |
|---|---|---|---|
| [EM-31] | 95% | 5% | 6.7% |

TABLE 5-continued

| Emulsion No. | Emulsion [EM-21] | proportion [EM-23] | Grain area ratio at an aspect ratio ≧3 |
|---|---|---|---|
| [EM-32] | 91% | 9% | 13.3% |
| [EM-33] | 87% | 13% | 17.0% |
| [EM-34] | 83% | 17% | 22.0% |
| [EM-35] | 79% | 21% | 26.8% |
| [EM-36] | 75% | 25% | 31.4% |

Each of the resulting emulsions was subject to the optimum gold sulfur sensitization and spectral sensitization. By making use of the resulting emulsions in Layers 9 (i.e., the green sensitive layers), the multilayered color photographic light sensitive material [Sample-31] through [Sample-36] were each prepared in the same manner as in Example-1 and the samples were then evaluated.

When taking the electron microscopic photographs of the cross-sections of the resulting samples and checking up the dispersibilities of the silver halide grains in Layers 9 of dispersibilities of the silver halide grains in Layers 9 of each sample, it was confirmed that every sample was proved to have a dispersibility of not less than 85% and that the samples were the photographic light sensitive materials of the invention.

With each sample, the relative fog density, relative sensitivity, relative RMS value and relative density variations in the pressurized portions thereof were measured by making use of green light (G). The results thereof are shown in Table 6.

TABLE 6

| Sample No. | Relative fog density | Relative sensitivity | Relative RMS | Relative density variation at the pressurized portions: Bent portion | Relative density variation at the pressurized portions: Scratched portion |
|---|---|---|---|---|---|
| Sample-31 | 100 | 100 | 100 | −100 | +100 |
| Sample-32 | 99 | 101 | 101 | −99 | +101 |
| Sample-33 | 100 | 102 | 99 | −100 | +100 |
| Sample-34 | 99 | 103 | 99 | −93 | +94 |
| Sample-35 | 101 | 103 | 100 | −90 | +91 |
| Sample-36 | 100 | 105 | 101 | −87 | +89 |

From the results shown above, it was proved that the effects of the invention can be particularly remarkable when the light sensitive layers of the invention are comprised of the grains each having a different aspect ratio and when the tabular-shaped grains each having an aspect ratio of not less than 3 have an area proportion of not less than 20%.

The effects of the invention could be confirmed when a multilayered color photographic light sensitive material was prepared in the same manner except that emulsions [EM-31] through [EM-36] were each used in Layers 5 (or, the red sensitive layers) or Layers 14 (or the blue sensitive layers), and when they were evaluated.

What is claimed is:

1. A silver halide color photographic light-sensitive material comprising a support having thereon a red-sensitive layer, a green-sensitive layer and a blue-sensitive layer, wherein at least one of said sensitive layers contains silver halide emulsion containing light-sensitive silver halide grains having a dispersibility (%) of not less than 85%; and wherein said silver halide emulsion is a core/shell-type emulsion.

2. The material of claim 1, wherein not less than 20% of said grains comprising silver halide grains have an aspect ratio of not less than 3 in total projective area.

3. The material of claim 1, wherein not less than 40% of said grains comprising silver halide grains have an aspect of ratio of not less than 3 in total projective area.

4. The material of claim 1, wherein not less than 60% of said grains comprising silver halide grains have an aspect of ratio of not less than 3 in total projective area.

5. The material of claim 2, wherein not less than 60% in total of said grains having an aspect ratio of not less than 3, comprise hexagonal tabular-shaped twinned crystal grains having a pair of twin planes comprising {111} faces parallel to each other.

6. The material of claim 2, wherein not less than 80% in total of said grains having an aspect ratio not less than 3, comprise hexagonal tabular-shaped twinned crystal grains having a pair of twin planes comprising {111} faces parallel to each other.

7. The material of claim 1, wherein the composition of said silver halide grains is silver iodobromide having an average silver iodide content within the range of 1 to 20 mol %.

8. The material of claim 1, wherein said core/shell type emulsion comprises a core section having an [iodine]iodide, as silver iodide. content within the range of 15 mol % to 40 mol %.

9. The material of claim 8, wherein the diffraction peak strength ratio of said core/shell type emulsion is within the range of 1/10 to 3/1.

10. The material of claim 1, wherein each of said silver halide grains comprises silver iodide and the silver iodide varies from a center of each of said silver halide grains to a surface phase and wherein the silver iodide contents of the surface phase of each of said silver halide grains is not more than 6 mol %.

11. The material of claim 10, wherein the silver iodine contents of the surface phase of said silver halide grains are within the range of 0 to 4 mol %.

12. A silver halide color photographic light-sensitive material comprising a support having thereon a red-sensitive layer, a green-sensitive layer and a blue-sensitive layer, wherein at least one of said sensitive layers contains silver halide emulsion containing light-sensitive silver halide grains having a dispersibility (%) of not less than 88% and said silver halide emulsion is a core/-shell-type emulsion, and wherein not less than 20% of said silver halide grains have an aspect ratio of not less than 3 in total projective area; and wherein not less than 60% of the total of said silver halide grains comprise hexagonal tabular crystal grains having a pair of twin planes comprising {111} faces parallel to each other.

13. A silver halide color photographic light-sensitive material comprising a support having thereon a red-sensitive layer, a green-sensitive layer and a blue-sensitive layer, wherein at least one of said sensitive layers contains light-sensitive silver halide grains having a dispersibility (%) of not less than 85%;

said silver halide grains being prepared by a process comprising the steps of:

(I) forming fine silver halide grains by mixing a silver salt and a halide solution in a mixer; and (II) supplying said fine silver halide grains into a reactor to form said silver halide grains; and wherein, in at least a part of said silver halide grains forming stage, substantially only said fine silver halide grains are supplied to the reactor at a mixing time being not less than 15 seconds.

* * * * *